United States Patent [19]

Morey

[11] Patent Number: 4,958,648

[45] Date of Patent: Sep. 25, 1990

[54] HAIR ROLLER AND HEAT SOURCE THEREFOR

[76] Inventor: Booker W. Morey, 2512 Cowper St., Palo Alto, Calif. 94301

[21] Appl. No.: 263,234

[22] Filed: Oct. 26, 1988

[51] Int. Cl.[5] ..... A45D 2/36

[52] U.S. Cl. ..... 132/220; 132/227; 132/229

[58] Field of Search ..... 132/220, 223, 227, 228, 132/229, 233, 269, 271

[56] References Cited

U.S. PATENT DOCUMENTS

| | | | |
|---|---|---|---|
| 1,776,820 | 9/1930 | Snell | 132/220 |
| 1,919,690 | 7/1933 | Evans | 132/220 |
| 2,109,632 | 3/1938 | Athens | 132/220 |
| 2,152,672 | 4/1939 | Solomon | 132/220 |
| 2,160,744 | 5/1939 | Lewit | 132/220 |
| 2,173,683 | 9/1939 | Goldfarb et al. | 132/220 |
| 2,261,221 | 11/1941 | Bruner | 132/220 |
| 2,630,809 | 3/1953 | Lewis et al. | 132/220 |
| 3,429,672 | 2/1969 | Young | 44/3 |
| 3,515,851 | 6/1970 | D'Elia et al. | 132/229 |
| 3,545,457 | 12/1970 | Schepis | 132/33 |
| 3,581,056 | 5/1971 | Djenner | 132/223 |
| 3,693,635 | 9/1972 | Garrett | 132/220 |
| 3,851,654 | 12/1974 | Kober | 132/229 |
| 3,924,603 | 10/1975 | Chapin | 126/263 |
| 4,053,337 | 10/1977 | Collins | 149/37 |
| 4,067,313 | 1/1978 | Donnelly | 126/263 |
| 4,095,583 | 6/1978 | Petersen et al. | 126/263 |
| 4,190,065 | 2/1980 | Kulpa | 132/33 R |
| 4,265,216 | 5/1981 | Marshall et al. | 126/263 |
| 4,338,098 | 7/1982 | Yamaji | 44/3 A |
| 4,520,832 | 6/1985 | Skovdal | 132/39 |
| 4,611,610 | 9/1986 | Schepis | 132/39 |

FOREIGN PATENT DOCUMENTS

| | | | |
|---|---|---|---|
| 0689495 | 6/1964 | Canada | 132/220 |
| 53-33754 | 3/1978 | Japan | 132/227 |
| 0554151 | 6/1943 | United Kingdom | 132/220 |

*Primary Examiner*—John J. Wilson
*Assistant Examiner*—Frank A. LaViole, Jr.
*Attorney, Agent, or Firm*—Victor R. Beckman

[57] ABSTRACT

A hair roller assembly is shown which includes a hollow roller member (12 and 60) containing a consumable heat source (14 and 62). The heat source is slidable into and out of engagement with the roller member such that, after use, the heat source may be removed and discarded and the roller member reused with a fresh consumable heat source. The heat source may include combustible material (40) or reactants (80). The combustible material is ignited by an electrical heating element (42) connectable to a battery (50). The reactants, when activated by liquid from a syringe (84), create an exothermic reaction for heating the roller member and hair wound thereon. The reactants are contained in a rupturable container (82) which is ruptured by the syringe needle (96) upon actuation of the syringe.

19 Claims, 3 Drawing Sheets

HAIR ROLLER AND HEAT SOURCE THEREFOR

FIELD OF THE INVENTION

This invention relates generally to hair rollers and to novel heat sources for heating the same

BACKGROUND OF THE INVENTION

Hair rollers having an externally accessable bore with a surrounding heatable surface are well known as shown, for example, in U.S. Pat. No. 4,520,832—Skovdal. Often, heatable hair rollers are provided with a wax-filled insert for additional heat storage when the roller is being heated. During use, heat from the wax is released thereby providing for an extended hairheating period. Hair curling devices which employ material that undergoes an exothermic chemical reaction, when wet, are known as shown in U.S. Pat. Nos. 4,190,065—Kulpa and 3,545,457—Schepis. These devices comprise laminated sheets between which an exothermic material, when wet, is located. The sheets are flexible enough to be formed into a roll, and the exothermic reaction is initiated by immersing the sheets in water which passes through small apertures in the package for contact with the exothermic material. When the exothermic material is expended, the curler is discarded. The sheet-type hair curling devices are not of conventional design and are not as easily used as many conventional hair rollers. Also, there is danger that products of the chemical reaction may leak through the sheets and produce deleterious effects. In addition, heaters of many different types are known in the prior art. For example, in addition to the above-mentioned chemical-/electrochemical heaters, there are electrical resistance heaters for rollers. Hair curling irons, alternatively, are either electrically heated or heated by catalytic combustion of butane.

SUMMARY AND OBJECTS OF THE INVENTION

An object of this invention is the provision of an improved hair roller which avoids the above-mentioned problems of the laminated sheet-type hair curlers that depend upon exothermic reactions as a source of heat.

An object of this invention is the provision of an improved hair roller having a reusable roller body and a disposable heat source whereby the heat source, but not necessarily the roller body, is disposed of following each use of the roller.

An object of this invention is the provision of an improved hair roller of the above-mentioned type which is compact, light-weight, and does not require use of a heater that must be plugged into an electrical wall outlet to heat the roller, and is particularly useful for travel.

The present invention includes a hollow roller body having an outer surface suitable for winding of hair therearound. If desired, a tubular body containing wax, or the like, may be included in the roller body for greater retention of heat. A heatable container is located inside the roller body, within which container a consumable heat source means is located for generating heat when activated. A sealed combustible heat source that emits no gases, or substantially no gases, may be located in the container which is ignited by use of an electrical resistance element therein. Electrical power to energize the resistance element may be obtained from a battery, a percussive igniter, a piezoelectric source such as used in a butane cigarette lighter, or the like. Alternatively, exothermic material, when wet, may be located in the heatable container together with a liquid which is separated from the exothermic material. Means are provided for combining the exothermic material with the liquid to initiate an exothermic reaction. Preferably, but not necessarily, the heatable container is removable from the roller body whereby the roller body may be reused with a fresh, unactivated heat source. Whether or not the heatable container is removable from the roller body, the heat source means is adapted for only a single use, and is disposed of following activation

BRIEF DESCRIPTION OF THE DRAWINGS

The invention, together with other objects and advantages thereof, will be better understood from the following description considered with the accompanying drawings. It will be understood that the illustrated embodiments of the invention included herein are by way of example only and that the invention is not limited thereto. In the drawings, wherein like reference numerals refer to the same parts in the several views.

Figure 1:
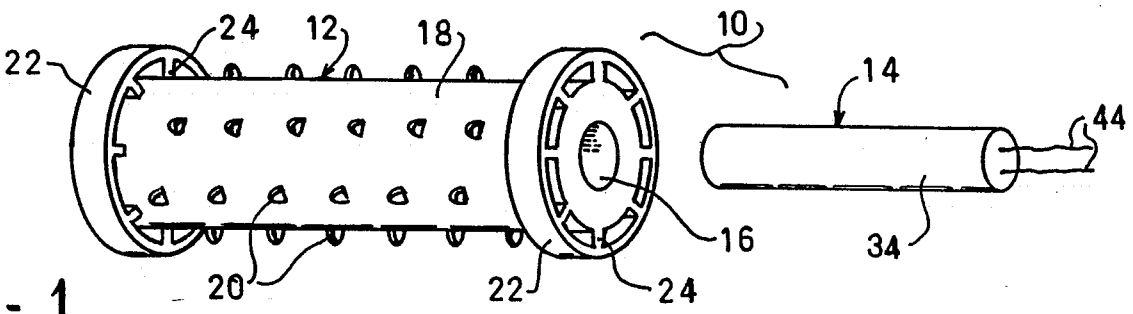
FIG. 1 is an isometric view of a roller body and associated heat source which is insertable into the roller body.
Figure 2:
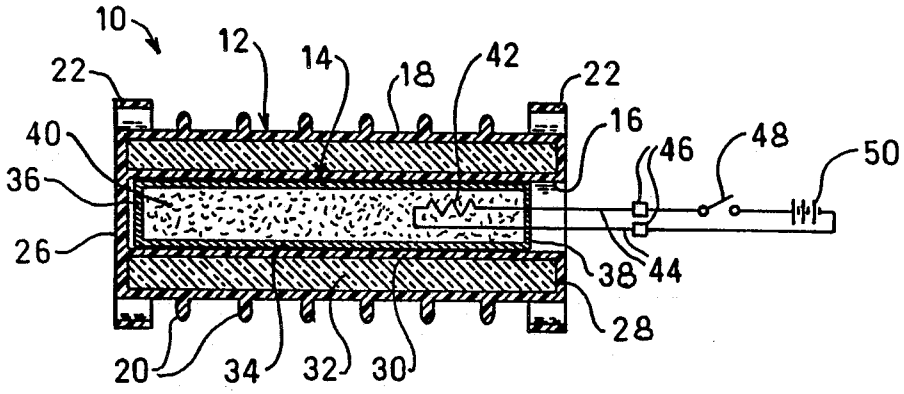
FIG. 2 is a longitudinal sectional view of the roller body and heat source but showing the heat source inserted into a cavity in the roller body.

Reference now is made to FIGS. 1 and 2 wherein a novel hair roller 10 embodying this invention is shown comprising a hollow roller member 12 and cylindrical-shaped disposable, consumable, heat source 14. Roller member 12 is formed with an axial cylindrical bore 16 to receive heat source 14 in axially slidable relationship therewith. Preferably, a relatively snug fit is provided between the heat source and bore to facilitate heat conduction therebetween.

Roller member 12, which may be of conventional design, includes a cylindrical body 18 upon which hair to be treated is wound. The body is formed with generally radially-extending protuberances 20 to facilitate winding of hair thereon. Also, enlarged diameter end members 22 are located at opposite ends of the roller body which are supported by radially extending arms 24 extending between the body and end members.

As seen in FIG. 2, one end of roller member 12 is closed by an end wall 26, and an annular end wall 28 is provided at the other, open, end of the roller. End walls 26 and 28 support tubular cylindrical member 30, and together with outer wall 18 form a tubular cavity containing wax 32, or other suitable material which when heated by heat source 14 changes from a solid to a liquid state to limit the temperature increase of the roller body and prolong the period of hair setting capability.

Heat source 14 comprises a cylindrical housing 34 closed at opposite ends by end walls 36 and 38. A combustible charge 40 is contained in the housing, which charge, when ignited, produces no gases, or substantially no gases, during combustion. The use of gasless, or substantially gasless, combustible reactants is required to avoid, or substantially avoid, gas pressure build-up within the sealed housing 34 and possible rupture thereof, and to avoid the odor of combustion. With substantially no increase in gas pressure during combustion, a low cost container of minimum strength may be employed.

Numerous gasless combustible reactants are known which are suitable for use in the present invention including, for example, diluted "Thermite", $Zr/Fe_2O_3$, $Fe/BaO_2$, $Al/MoO_3$, $Fe/KClO_4$, $Zr/KClO_4$, or $Zr/BaCrO_3$. As is well understood, "Thermite" comprises a mixture of fine grains of aluminum with an oxide of a chemically weaker metal, such as iron which, when heated, produces an aluminothermic reaction. Generally, the "Thermite" or reaction mixture, must be diluted by inclusion of substantially non-reactive material in the mixture. Suitable dilution material includes, for example, diatomaceous earth or other silicates, or excess iron oxide, or calcium oxide. Dilution is needed to reduce the peak temperatures to a range compatible with the hair-curling application. Combustion of mixture 40 is initiated by use of a resistance heating element 42 inside housing 34 which is attached to electrical wires 44 extending through end wall 38. In the arrangement of FIG. 2, wires 44 are adapted for connection through connectors 46 and optional switch 48 to a voltage source 50, such as a nine-volt battery. When switch 48 is closed current flow from battery 50 heats element 42 to initiate combustion of charge 40.

Figure 3:
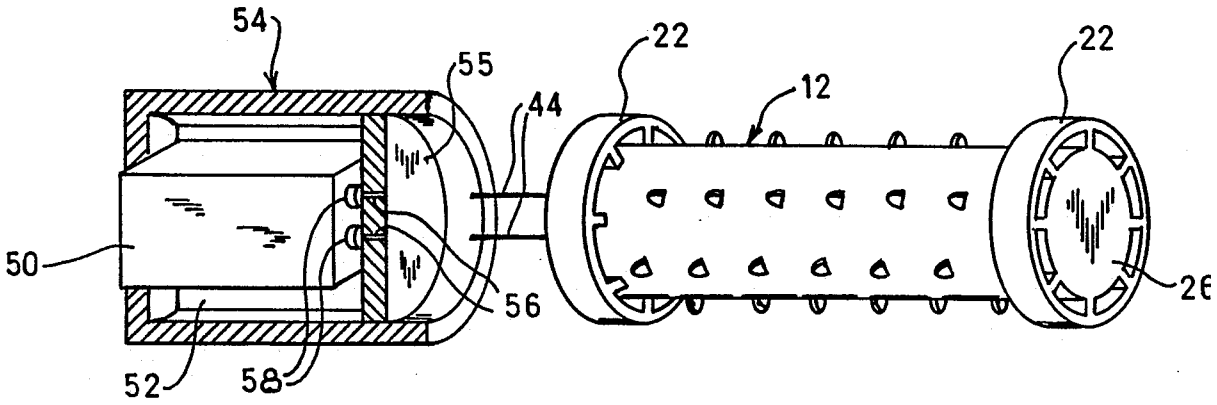
FIG. 3 is an isometric view of the roller shown in FIGS. 1 and 2 together with a unit for use in initiating combustion of combustible material contained in the associated heat source, the case of the unit being show broken away for clarity.

In FIG. 3, to which figure reference now is made, battery 50 is shown located in a cavity 52 formed in a housing, or carrier 54. A dividing wall 55 inside the cavity is provided with a pair of through holes 56 which are in alignment with terminals 58 of the battery, through which holes wires 44 are adapted to be extended. To initiate combustion, wires 44 are extended through the holes 56 to place them into electrical contact with the battery terminals 58. When the electrical circuit to the heating element 42 is completed, current flow to the element is sufficient to melt the element thereby terminating the current flow. Consequently, current drain on the battery is limited to an initial surge which generates sufficient heat to initiate combustion of the reactants and to burn out the heater element.

After initiation of combustion, a peak outside roller temperature in the range of 135° to 160° F. is reached and a temperature of 130° F. is held, or exceeded, for over four minutes, which is ample time for setting hair. This performance exceeds the temperature retention of many commercially available electrically heated rollers. The time interval from initiation until the outer surface of the roller exceeds 130° F. is approximately 60 seconds, which is faster than most electrically heated rollers, and is a highly desirable characteristic of the roller. Since combustion takes place within a sealed container, no gases or other material escape therefrom in use, and the user is protected against harm or odor from the combustion products. After use, heat source 14 is withdrawn from the roller body, as by pulling on wires 44, and discarded. Roller member 12 is left intact for reuse with a new heat source 14. Alternatively, roller member may be reused with conventional, prior art, heating apparatus, including electric heating elements, if desired.

Figure 4:
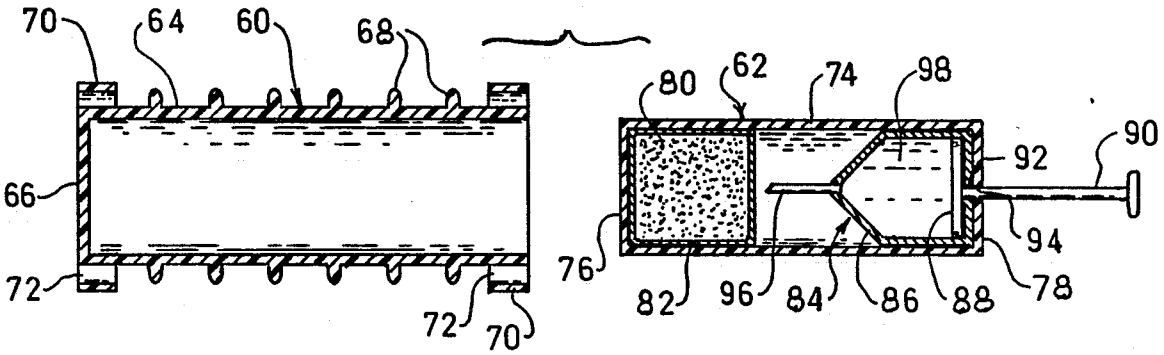
FIG. 4 is a longitudinal sectional view of a modified form of hair roller showing a heat source which includes exothermic material and a fluid-containing syringe for wetting the material and initiating an exothermic reaction.
Figure 5:
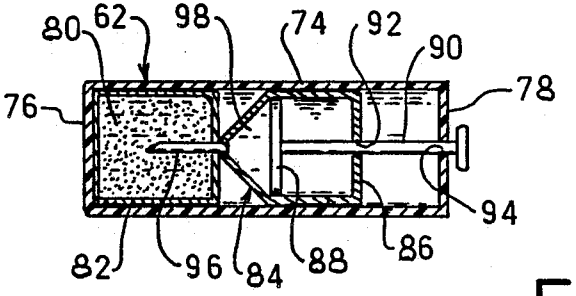
FIG. 5 is a longitudinal sectional view of the syringe shown in FIG. 3 but showing the syringe in an actuated condition wherein fluid from the syringe is injected into the container of exothermic material.

A modified form of this invention employing exothermic material is shown in FIGS. 4 and 5, to which figures reference now is made. This arrangement also includes a separate roller member 60 and consumable heat source 62. Roller member 60 comprises a cylindrical body 64 which is open at one end and closed by end wall 66 at the other end. Again, for purposes of illustration, body 64 is shown formed with radially extending protuberances 68 and enlarged diameter end members 70 at opposite ends of the body which are supported by radially extending arms 72 that extend between the body and end members. Unlike the hair roller of FIGS. 1–3 no wax containing chamber is included in the arrangement of FIGS. 4 and 5.

Heat source 62, which slideably fits inside the roller body, includes a cylindrical body 74 closed at opposite ends by end walls 76 and 78. Reactants 80 for an exothermic reaction are sealed in a separate impervious frangible container 82 located adjacent end wall 76. Container 82 is made of rupturable material, such as aluminum foil, which, when loaded with reactants 80, is readily sealed to maintain the reactants in a dry condition.

A syringe 84 is located inside container 74 opposite reactant container 82 and is axially slidable therewithin. It includes a fluid-containing cylinder 86 and axially movable piston, or plunger, 88. A push rod 90 attached to piston 88 extends through apertures 92 and 94 in cylinder 86 and end wall 78, respectively. A syringe needle 96 extends from the opposite end, facing reactant container 82.

With heat source 62 located inside roller member 60, push rod 90 extends outwardly from the open end of the roller member for easy access by the operator. To initiate an exothermic reaction, push rod 90 is urged inwardly, to the left as viewed in the drawings, with sufficient force to axially move the entire syringe to the left whereupon needle 96 punctures, or penetrates, the wall of container 82. Movement of syringe 84 to the left continues until the syringe cylinder 86 engages container 82. Now, as force on plunger 88 is continued, the plunger is moved relative to cylinder 86 so as to expel liquid reactant 98 from the syringe and into container 82 to initiate an exothermic reaction. After use, heat source 62 may be removed from roller body 60 by pulling on rod 90.

A preferred mix of reactants includes 3 grams of 83% water-treatment-quality calcium oxide (ground to −8 mesh) and 17% anhydrous magnesium chloride. An equal volume of a dilutant, such as superabsorbent cellulose fiber, is mixed with the reactants. Water is contained in syringe 84 to initiate an exothermic reaction. The resultant reaction emits very slight steam, and releases no odor. Products of the reaction are substantially contained inside body, or housing, 74 of heat source 62. After two minutes, a temperature exceeding 130° F. is reached at the outer surface of roller member 60, which holds for at least two minutes, which is ample time for setting the hair. A maximum temperature of 140° F. is achieved. As noted above, after use, the heat source 62 is removed and discarded.

Water-treatment-quality lime is preferred because it has been produced to be rapidly hydrated with water. Other classes of lime, e.g. dead burned lime may not react quickly with water. It has been found that the lime reacts more readily and predictably with hot water. To achieve this, a highly exothermic water reactive material is added to the lime. Out of many possibilities, including $Na_2O_2+Al$, $AlCl_3$, etc. $MgCl_2$ is preferred. It reacts quickly and does not generate corrosive by-products unlike the highly caustic reagents and by- products of reacting aluminum with the caustic sodium compound reactant $Na_2O_2$. The distribute water throughout the reactive mass, achieving a smooth and complete reaction. Obviously, other hydrophillic substances can be used to distribute the water and these need not be "superabsorbent". It here will be apparent that lime without the inclusion of a highly exothermic water reactive material to heat the water may be employed, if desired.

Obviously, reactants other than lime may be employed which, when mixed with water, result in an exothermic reaction. These include, for example, $MgCl_2$, NaOH a caustic sodium compound reactant+Al, $Na_2O_2+Al$ or Mg, FeSi+NaOH and mixtures such as described in U.S. Pat. No. 3,725,156. Generally, such reactants must be mixed with a dilutant (e.g. diatomaceous earth) to reduce the roller peak temperature by reducing the intensity, or rate of reaction, thereby making it suitable for hair-curling use.

However, it will be understood that the reactants NaOH+Al, $Na_2O_2+Al$ or Mg, and FeSi+NaOH all release hydrogen when mixed with water which must be vented and may pose a fire hazard. The mixtures described in U.S. Pat. No. 3,725,156 also release a gas, specifically oxygen, which must be vented. Although such reactants may be employed, it will be apparent that those that generate substantially no gases when mixed with water are preferred to avoid gas pressure build-up, the need for venting, and odor of combustion.

Although operation of the hair rollers of this invention is believed to be apparent, a brief description thereof now will be provided. With the associated heat source inserted in the roller member, the source is activated for the generation of heat inside the roller member. Activation of the heat source of the arrangement shown in FIGS. 1-3 involves igniting combustible material 40 by connection of electrical resistance heating element 42 to voltage source 50. When ignition has been initiated, voltage source 50 is disconnected from heating element 42. Hair to be curled then is wound around the hair curler body and secured thereto by any suitable means, not shown. Heat from source 14 melts wax 32 and heats the outer surface of roller member 12. The roller member is left in place for several minutes to allow time for hair wound on the curler to set, after which the curler is removed from the hair, and the heat source as removed from the curler member and discarded.

Activation of the heat source of the FIGS. 4 and 5 arrangement involves injecting water from syringe 84 into reactants 80 in sealed pouch, or container, 82 by applying a firm axial force on plunger rod 90 extending from the end of the roller body. Initially, pushing on plunger rod 90 results in axial movement of the syringe container 86 for penetration of container 82 by needle 96. Movement of the syringe container is stopped by engagement thereof with container 82. (Alternatively, a stop may be provided at the inner wall of body 74 to limit axial movement of syringe 84.) With axial movement of syringe container 86 stopped, continued pressure on push rod 90 results in movement of plunger 88 therewithin for injection of water into reactants 80. The resultant exothermic reaction heats the roller member 60 to set hair wound thereon. After use, roller member 60 is removed from the hair, and heat source 62 is removed from roller member 60 and is discarded.

The invention having been described in detail in accordance with requirements of the patent Statutes, various other changes and modifications will suggest themselves to those skilled in this art. For example, the combustible materials and the exothermic reactants and liquid mentioned above are for purposes of illustration only, and numerous other materials suitable for use herein will suggest themselves to those skilled in this art. However, as noted above, use of combustible reactants which generate substantially no gases during combustion are required in the FIGS. 1-3 arrangement wherein the reactants are located in a sealed container. Also, although consumable heat sources which are removable from the hair curler member have been shown, it will be apparent that a unitary hair curler and heat source may be easily made in which the heat source is non-removable from the hair roller member. In this case, both the roller member and heat source are discarded after use. Also, it is preferable that the roller body include an aluminum or other metal inner liner to help distribute the heat from the heat source evenly. Voltage sources other than batteries may be used to provide the necessary current for heater element 42 in the FIGS. 1-3 arrangement. For example, percussive igniters may be used in place of batteries. Also, a low voltage power supply which plugs into a conventional voltage outlet may be used. Alternatively, a piezoelectric source such as used in a butane cigarette lighter may be employed as a voltage source. Additionally, in the arrangement employing an exothermic material, when wet, together with a liquid, other means may be employed to separately maintain the reactants and liquid until the generation of heat is required. Other methods for mixing liquids and solids are shown in U.S Pat. Nos. 4,285,210—Marshall et al, 4,095,583—Petersen et al., 4,067,313—Donnelly and 3,924,603—Chapin. Also water may be supplied from the reaction of solid substances, in which case no storage of water for mixing with the exothermic material is required. Such an arrangement is illustrated in U.S. Pat. No. 4,338,098—Yamaji. It is intended that the above and other such changes and modifications shall fall within the spirit and scope of the invention as defined in the appended claims.

I claim:

1. A hair roller assembly comprising, a tubular roller member having a heatable inner surface and an outer surface suitable for winding hair therearound, a container having a substantially rigid outer wall slidably engaged with the inner surface of the roller member for insertion into and removal from inside the tubular roller member, said container outer wall being in heat transferring relationship with the heatable inner surface of the roller member when the container is inserted in the roller member, heat source means comprising consumable heat source material enclosed inside said container which is useable only once for generating heat when activated, means inside the container for activating the consumable heat source material inside said container, means under user control for controlling activation of the consumable material by the activating means for initializing consumption of the consumable heat source material for generation of heat inside said container, which heat is transferred through the container wall to the heatable inner surface of the roller member for heating the roller member and hair wound thereon to an elevated temperature for a period of time for curling the hair, said container with consumed heat source material contained therein being removable from the roller member after use for reuse of the roller member with another container with consumable heat source material and activating means enclosed therein.

2. A hair roller assembly comprising, a tubular roller member having a heatable inner surface and an outer surface suitable for winding hair therearound, a closed container having a substantially rigid outer wall slidably engagable with the inner surface of the roller member for insertion into and removal from inside the tubular roller member, said container outer wall being in heat transferring relationship with the heatable inner surface of the roller member when the container is inserted in the roller member, heat source means comprising combustible material inside said container which is useable only once for generating heat when burned, means enclosed inside the container for igniting the combustible material contained therein, means under user control for controlling the igniting means for initializing combustion of the combustible material and generation of heat by combustion of the combustible material inside said container, which heat is transferred through the rigid outer wall of the container to the heatable inner surface of the roller member for heating the roller member and hair wound thereon to an elevated temperature for a period of time for curling hair wound thereround, said container with burned combustible material contained therein being removable from the roller after use for reuse of the roller member with another container with combustible material and igniting means enclosed therein.

3. A hair roller assembly as defined in claim 2 wherein said combustible material burns with production of substantially no gases.

4. A hair roller assembly as defined in claim 3 wherein said combustible material comprises a mixture of fine grains of metal and an oxide of a chemically weaker metal.

5. A hair roller assembly as defined in claim 3 wherein said container comprises a sealed container which remains sealed throughout combustion of the combustible material for preventing leakage of products of combustion therefrom.

6. A hair roller assembly as defined in claim 2 wherein said igniting means comprises an electrical heating element in contact with the combustible material, and said means for controlling the igniting means for initializing combustion of the consumable material comprises means for connecting the electrical heating element to a voltage source for generating heat and initiating combustion of the combustible material.

7. A hair roller assembly comprising a tubular roller member having a heatable inner surface and an outer surface suitable for winding hair therearound, a container having a substantially rigid outer wall slidably engaged with the inner surface of the roller member for insertion into and removal from inside the tubular roller member, said container outer wall being in heat transferring relationship with the heatable inner surface of the roller member when the container is inserted in the roller member, heat source means inside said container comprising a reactant system which includes liquid and dry reactants which create an exothermic reaction when intermixed, impervious frangible means for separating said liquid and dry reactants inside said container, penetrating means, means under user control for rupturing the frangible separating means by the penetrating means and initiating an exothermic reaction between said liquid and dry reactants for generating of heat which is transferred through the rigid outer wall of the container to the heatable inner surface of the roller member for heating the roller member and hair wound thereon to an elevated temperature for a period of time for curling hair wound thereon, said container with spent reactants therein being removable from the roller after use for reuse of the roller member with another container with unspent heat source means therein.

8. A hair roller assembly as defined in claim 7 wherein said liquid comprises water.

9. A hair roller assembly as defined in claim 7 wherein said dry reactant comprises a mixture of calcium oxide and anhydrous magnesium chloride.

10. A hair roller assembly as defined in claim 7 including absorbent hydrophilic material with said dry reactant to hold and distribute said liquid throughout the dry reactant for smooth and complete reaction thereof.

11. A hair roller assembly as defined in claim 10 wherein said dry reactant comprises a mixture of calcium oxide and $MgCl_2$.

12. A hair roller assembly as defined in claim 11 wherein said dry reactant mixture includes aluminum powder and caustic sodium compound.

13. A hair roller assembly as defined in claim 12 wherein said caustic sodium compound comprises NaOH.

14. A hair roller assembly as defined in claim 12 wherein said caustic sodium compound comprises $Na_2O_2$.

15. A hair roller assembly as defined in claim 10 wherein said dry reactant comprises a mixture of calcium oxide, aluminum powder, and caustic sodium compound.

16. A hair roller assembly as defined in claim 15 wherein said caustic sodium compound comprises NaOH.

17. A hair roller assembly as defined in claim 15 wherein said caustic sodium compound comprises $Na_2O_2$.

18. A hair roller assembly comprising, a hollow roller member having an outer surface suitable for winding of hair therearound, said roller member having a bore with a surrounding heatable surface, consumable heat source means inside said bore which is useable only once for generating heat when activated, said consumable heat source means comprising means for creating an exothermic reaction when activated by a liquid, a container for containing said consumable heat source means, a liquid for activating the consumable heat source means for generating heat inside said bore and heating the roller member and hair wound thereon, a syringe for containing said liquid, which liquid is injectable into said heat source means upon actuation of said syringe, means for mixing the liquid activating means with the consumable heat source by actuation of said syringe and injection of the liquid activating means into the heat source means.

19. A hair roller assembly as defined in claim 18 wherein said container for containing said consumable heat source means comprises a rupturable sealed container, said syringe being movable relative to said rupturable container for rupture of the rupturable container by the syringe upon movement of the syringe into engagement therewith.

* * * * *